United States Patent [19]

Ochiai

[11] Patent Number: 4,631,373

[45] Date of Patent: Dec. 23, 1986

[54] PUSH-BUTTON SWITCH LOCKING DEVICE FOR USE IN ELECTRIC APPLIANCE

[75] Inventor: Masahiko Ochiai, Nogata, Japan

[73] Assignee: Kyushu Hitachi Maxell, Ltd., Fukuoka, Japan

[21] Appl. No.: 693,271

[22] Filed: Dec. 18, 1984

Related U.S. Application Data

[62] Division of Ser. No. 475,156, Mar. 14, 1983, Pat. No. 4,504,707.

[30] Foreign Application Priority Data

| | | | |
|---|---|---|---|
| Mar. 15, 1982 | [JP] | Japan | 57-36698[U] |
| May 17, 1982 | [JP] | Japan | 57-72843[U] |
| Jul. 8, 1982 | [JP] | Japan | 57-104664[U] |
| Jul. 8, 1982 | [JP] | Japan | 57-104666[U] |

[51] Int. Cl.[4] ..... H01H 3/20

[52] U.S. Cl. ..... 200/43.17; 200/43.18

[58] Field of Search ..... 200/321, 322, 327, 328, 200/334, 42 T, 43.17, 43.18, 157

[56] References Cited

U.S. PATENT DOCUMENTS

| | | | |
|---|---|---|---|
| 2,579,168 | 12/1951 | Ballou | 200/243 |
| 2,641,671 | 6/1953 | Koenig et al. | 200/325 |
| 2,810,050 | 10/1957 | Johnson | 200/328 |
| 3,461,556 | 8/1969 | Chambers | 200/157 |
| 3,953,696 | 4/1976 | Reimann et al. | 200/328 |
| 3,959,609 | 5/1976 | Laing et al. | 200/322 |

FOREIGN PATENT DOCUMENTS

| | | | |
|---|---|---|---|
| 659242 | 3/1963 | Canada | 200/328 |
| 2348668 | 4/1975 | Fed. Rep. of Germany | 200/328 |
| 1359686 | 7/1974 | United Kingdom | 200/321 |

*Primary Examiner*—Stephen Marcus
*Assistant Examiner*—Renee S. Luebke
*Attorney, Agent, or Firm*—Birch, Stewart, Kolasch & Birch

[57] ABSTRACT

A push-button switch locking device for use in an electric appliance including a casing, a push-button and a switch. The device includes a sliding knob which is mounted on the casing so as to be slid in a direction at right angles to a direction of depression of the push-button, and a locking piece which is provided so as to be operated upon displacement of the sliding knob such that the push-button is locked and unlocked, respectively.

5 Claims, 23 Drawing Figures

PUSH-BUTTON SWITCH LOCKING DEVICE FOR USE IN ELECTRIC APPLIANCE

This application is a divisional of copending application Ser. No. 475,156, filed on Mar. 14, 1983 now U.S. Pat. No. 4,504,707.

BACKGROUND OF THE INVENTION

The present invention generally relates to electric appliances and more particularly, to a push-button switch locking device for use in an electric appliance of the type having a push-button switch.

Small-sized electric appliances such as an electric shaver, electric hair clippers, a portable audio appliance, etc., each provided with a push-button switch are known. However, the prior art electric appliances have inconveniences in that, although the push-button switches can be operated lightly through the depression thereof by the fingers of an user, such push-button switches are likely to be accidentally turned on through inadvertent contact of the push-button with other articles when the electric appliances are carried about in bags and the like or kept in custody, with the result that batteries for the electric appliances are undesirably discharged unnecessarily.

In order to eliminate such a drawback of the known electric appliances as described above, there has been proposed push-button switch locking devices for use in the electric appliances, each including a locking member. However, the conventional push-button switch locking devices for use in electric appliances have such a disadvantage that, since the locking member is spaced away from the push-button switch, the user is required to operate the push-button switch after the push-button switch has been unlocked through manipulation of the locking member, so that the user cannot operate the push-button switch locking device and the push-button switch very quickly and in an efficient manner and thus, the user is inclined to fail to operate the push-button switch locking device.

Furthermore, the prior art push-button switch locking devices for use in the electric appliances have been disadvantageous in that the push-button switch locking devices are complicated in structure, thereby resulting in frequent malfunctions of the devices.

SUMMARY OF THE INVENTION

Accordingly, an essential object of the present invention is to provide an improved push-button locking device for use in an electric appliance of the type having a push-button switch, wherein a locking operation of the push-button locking device and a switching operation of the push-button switch can be performed quite easily, with the substantial elimination of the disadvantages inherent in conventional push-button switch locking devices of this kind.

Another important object of the present invention is to provide an improved push-button switch locking device of the above described type which is simple in structure, highly reliable in actual use, suitable for mass production at low cost, and can be incorporated into electric appliances such as an electric shaver, electric hair clippers, a portable audio appliance, etc. at low cost.

In accomplishing these and other objects according to one preferred embodiment of the present invention, there is provided an improved push-button switch locking device for use in an electric appliance including a casing, a push-button mounted on a portion of the outer surface of said casing, and a switch provided in said casing, with said switch being connected to said push-button such that said push-button and said switch constitute a push-button switch, said push-button switch locking device comprising: a sliding knob which is slidably mounted on the outer surface of said casing so as to be slid between a locking position of said push-button and an unlocking position of said push-button in a direction at right angles to the direction of depression of said push-button; and a locking piece which is provided so as to be operated upon displacement of said sliding knob such that said push-button is locked and unlocked, whereby said push-button switch is locked and unlocked, respectively.

In accordance with the present invention, since the sliding knob of the push-button switch locking device is provided adjacent to the push-button switch so as to be slid in the direction at right angles to the direction of the depression of the push-button, the push-button switch and the sliding knob can be positively operated quickly with much ease.

Furthermore, in accordance with the present invention, the push-button switch locking device has been simplified in structure with a consequent minimized occurrence of its failures.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
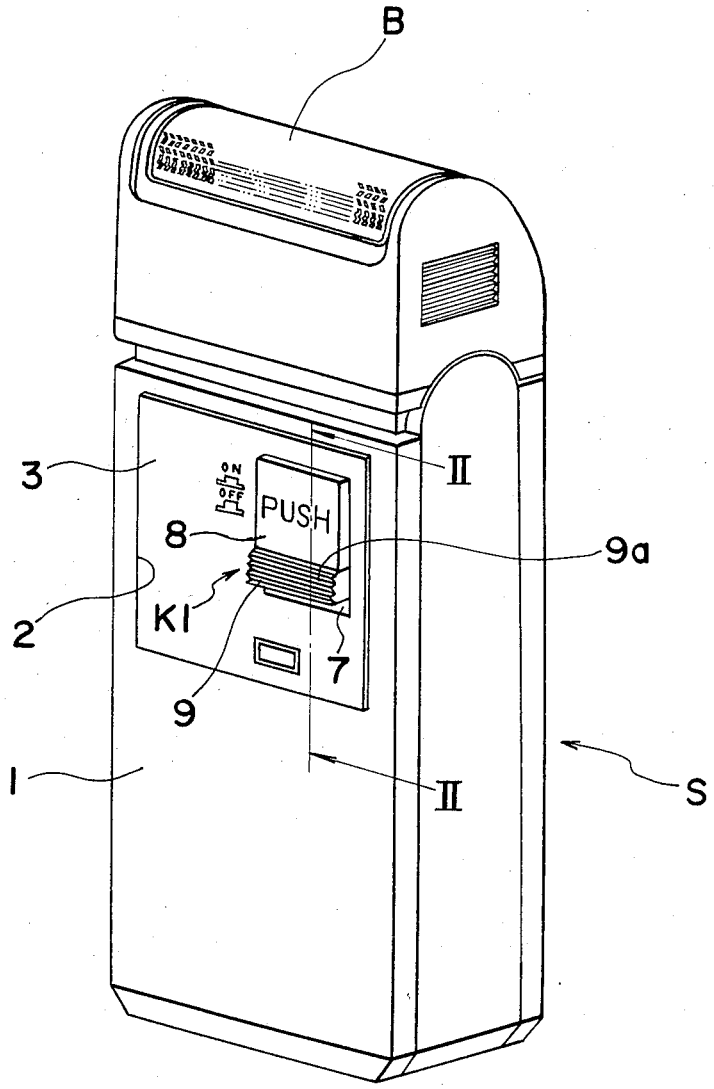
FIG. 1 is a perspective view of an electric shaver, in which a push-button switch locking device according to a first embodiment of the present invention is incorporated.

Referring now to the drawings, there is shown in FIGS. 1 to 4, an electric shaver S of a type having a push-button switch, in which a push-button switch locking device K1 according to a first embodiment of the present invention is incorporated. The electric shaver S includes a casing 1, an aperture 2 of rectangular shape formed on a front wall of the casing 1, a switch panel 3 fitted in the aperture 2, and an outer blade or screen blade B provided at an upper portion of the casing 1. It is to be noted here that all directional indications such as "upper", "front", etc. relate to the illustration in FIGS. 1 and 4, hereinbelow. The electric shaver S further includes a printed circuit board 4 attached to an inner face of a rear wall of the casing 1, a switch 5 for energizing and de-energizing a power source of the electric shaver S, and a battery 6 acting as the power source of the electric shaver S. The printed circuit board 4 is disposed in the casing 1 so as to confront the aperture 2 such that the switch 5, the battery 6 and other circuit components are mounted on the printed circuit board 4.

The switch panel 3 is formed with an opening 7 of rectangular shape such that a push-button 8 having a rectangular configuration and made of, for example, plastic material is fitted into an upper portion of the opening 7. It should be noted that the push-button 8 and the switch 5 constitute a push-button switch for the electric shaver S. The push-button 8 has a projection 10 extending toward the switch 5 into the casing 1. Furthermore, a sleeve 11 of rectangular cross section having an inner member 11*a* is provided on the switch 5 whereby holes in the inner member 11*a* receive tangson 2 the projection 10. It is so arranged that the projection 10 fits into the sleeve 11. When the push-button 8 is depressed, the sleeve is brought into contact with the switch 5 whereby the switch 5 is turned on. It is further to be noted that the switch 5 is turned on upon depression of the push-button 8 from an OFF position to an ON position toward the rear wall of the electric shaver S and the push-button 8 is retained at the ON position even if a user releases his fingers from the push-button 8 thereafter such that the push-button 8 is returned to the OFF position when the user depresses the push-button 8 again.

The push-button switch locking device K1 of the present invention includes a sliding knob 9 fitted into a lower portion of the opening 7, and a locking piece 12 integrally formed with the sliding knob 9. The sliding knob 9 made of, for example, plastic material and having an operating face 9*a* formed with a plurality of notches is slidably fitted into the opening 7 so as to be slid in a direction at right angles to the direction of depression of the push-button 8, i.e. in the upward and downward directions of the electric shaver S. The locking piece 12 is disposed rearward of the push-button 8 so as to extend upwardly from the sliding knob 9. It is so arranged that, when the sliding knob 9 is pushed upwardly and downwardly at the OFF position of the push-button 8, an upper end of the locking piece 12 is fitted into and released from a recess 13 formed on a bottom wall of the sleeve 11, respectively. More specifically, when the sliding knob 9 is pushed upwardly to a locking position of the push-button 8 at the OFF position of the push-button 8, the locking piece 12 is fitted into the recess 13 of the sleeve 11 so as to prevent the sleeve 11 and consequently the projection 10 of the push-button 8 from being further depressed, whereby the push-button 8 is locked. Subsequently, when the sliding knob 9 is pushed downwardly to an unlocking position of the push-button 8 at the OFF position of the push-button 8, the locking piece 12 is released from the recess 13 so as to allow the sleeve 11 and consequently the projection 10 to be depressed, whereby the push-button 8 is unlocked. Thus, when the push-button 8 is depressed at this time, the switch 5 is turned on so as to energize the power source of the electric shaver S. Thereafter, when the push-button 8 is depressed again, the push-button 8 is returned to the OFF position so as to project out of the opening 7 such that the power source of the electric shaver S is de-energized.

Figure 2:
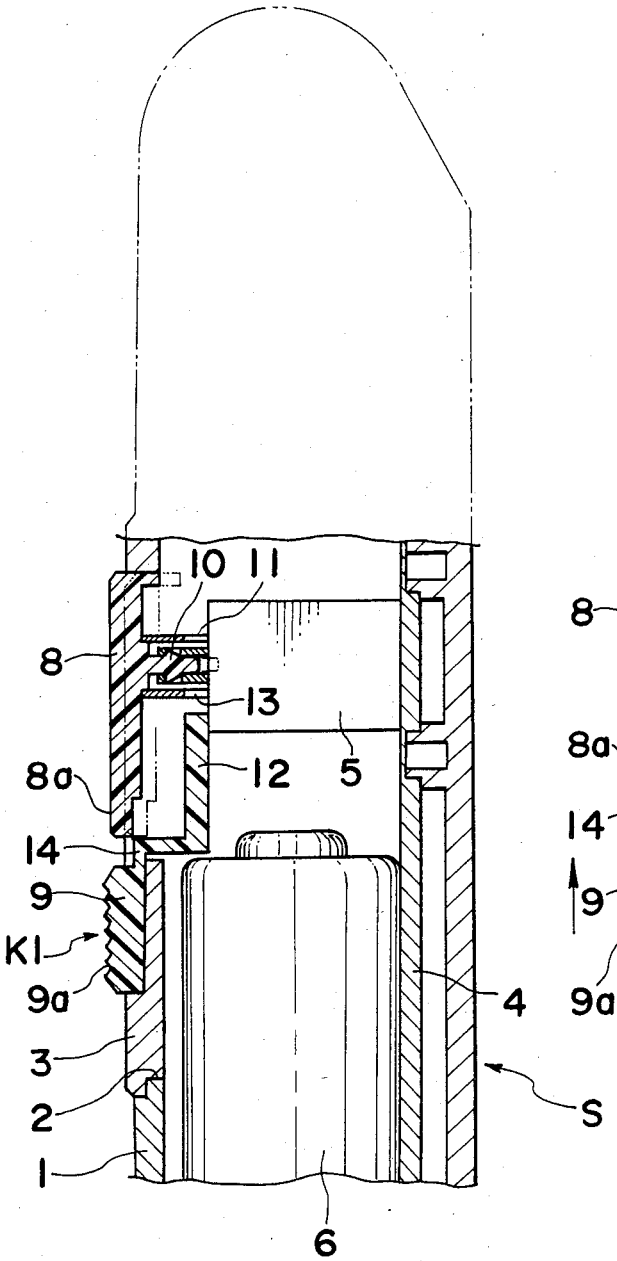
FIG. 2 is a cross-sectional view taken along the line II—II in FIG. 1.
Figure 3:
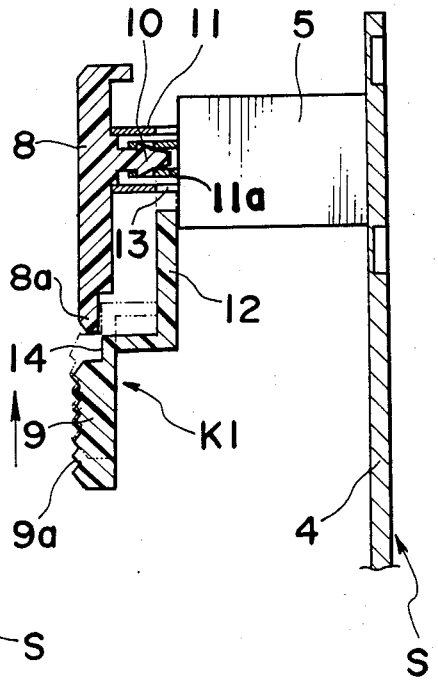
FIG. 3 is a view explanatory of locking of a push-button switch employed in the electric shaver of FIG. 1.
Figure 4:
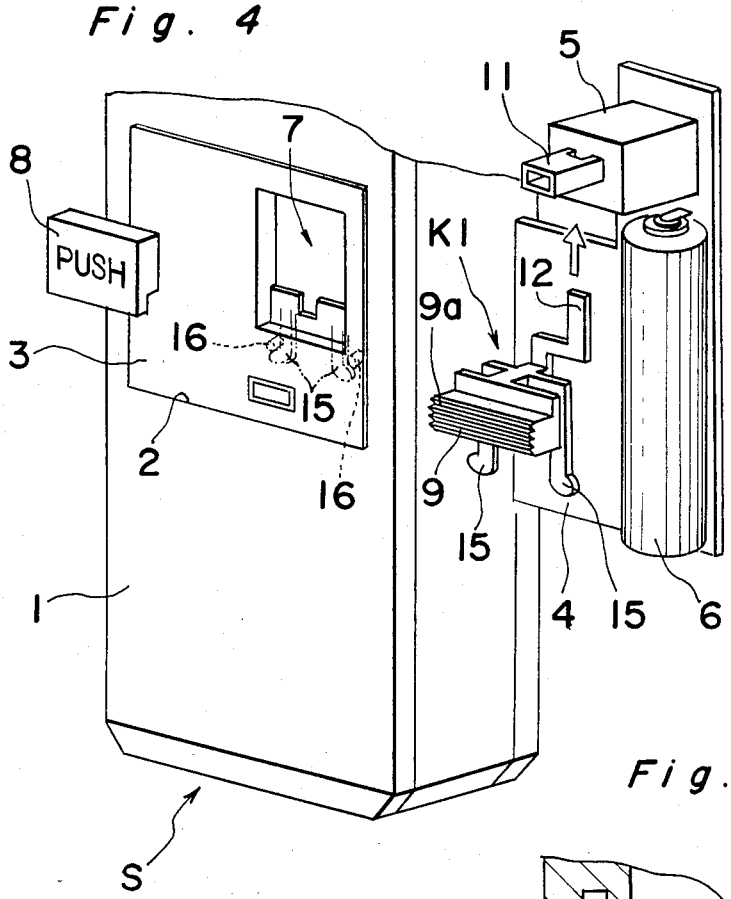
FIG. 4 is a fragmentary exploded perspective view of the electric shaver of FIG. 1.

Meanwhile, as best shown in FIGS. 2 and 3, the sliding knob 9 has a step portion 14 formed at an upper edge portion thereof. The step portion is so arranged that, when the sliding knob 9 is disposed at the locking position of the push-button 8, a rear face of a lower end portion 8*a* of the push-button 8 is supported by the step portion 14 such that the push-button 8 is positively prevented from being depressed at the locking position of the push-button 8. Furthermore, the push-button switch locking device K1 includes a pair of legs 15 extending downwardly from the sliding knob 9, and a pair of protrusions 16 provided on the casing 1. The switch locking device K1 is so arranged that, when the sliding knob 9 is pushed upwardly to the locking position of the push-button 8 at the OFF position of the push-button 8, the legs 15 are brought into contact with the protrusions 16 so as to ride over the protrusions 16 through elastic deformation of the legs 15, respectively such that the legs 15 are, respectively, caused to rest on the protrusions 16 at the locking position of the sliding knob 9, whereby the sliding knob 9 is positively retained at the locking position of the push-button 8 so as not to be undesirably lowered from the locking position of the push-button 8 to the unlocking position of the push-button 8.

The above described arrangement of the legs 15 and the protrusions 16 can be replaced by an arrangement in which a sliding frictional force between the sliding knob 9 and the opening 7 of the switch panel 3 is increased, or an arrangement in which the locking piece 12 is more securely fitted into the recess 13.

Meanwhile, although the locking piece 12 is brought into and out of engagement with the sleeve 11 in the push-button switch locking device K1 according to the first embodiment of the present invention, it can be so arranged that the locking piece 12 is brought into and out of contact with the projection 10.

Hereinbelow, a push-button switch locking device K2 according to a second embodiment of the present invention will be described with reference to FIGS. 5 to 7.

The push-button switch locking device K2 includes a locking piece 12' formed with an opening 12'*a* of rectangular shape, and a projection 17 provided on the inner face of the push-button 8. The opening 12'*a* is arranged to receive the sleeve 11 therethrough. Furthermore, the locking piece 12' has a contact face 18 confronting the push-button 8 and a hole 19 formed above the opening 12'*a*. It is so arranged that the projection 17 is brought into alignment with the hole 19 at the unlocking position of the push-button 8 so as to allow the push-button 8 to be depressed toward the rear wall of the casing 1 as shown in FIG. 5 and that the projection 17 is brought into contact with the contact face 18 at the locking position of the push-button 8 so as to prevent the push-button 8 from being depressed toward the rear wall of the casing 1 as shown in FIG. 7.

Figure 5:
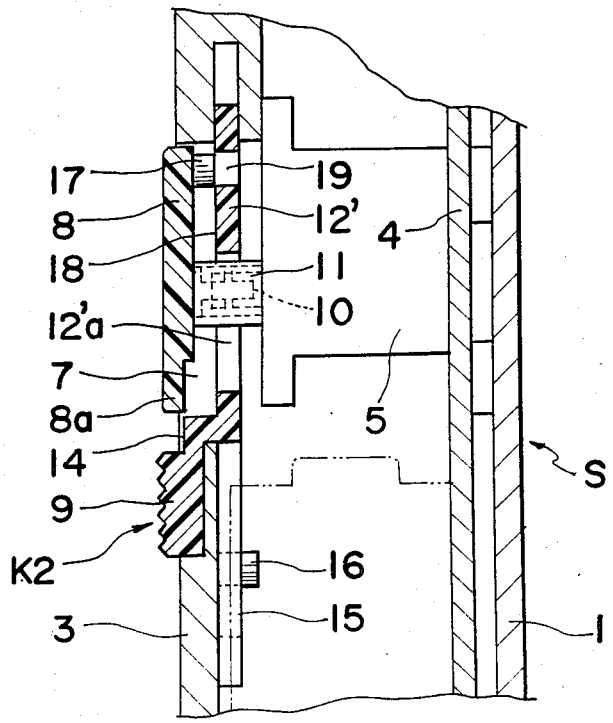
FIG. 5 is a view similar to FIG. 2, particularly showing a push-button switch locking device according to a second embodiment of the present invention.
Figure 6:
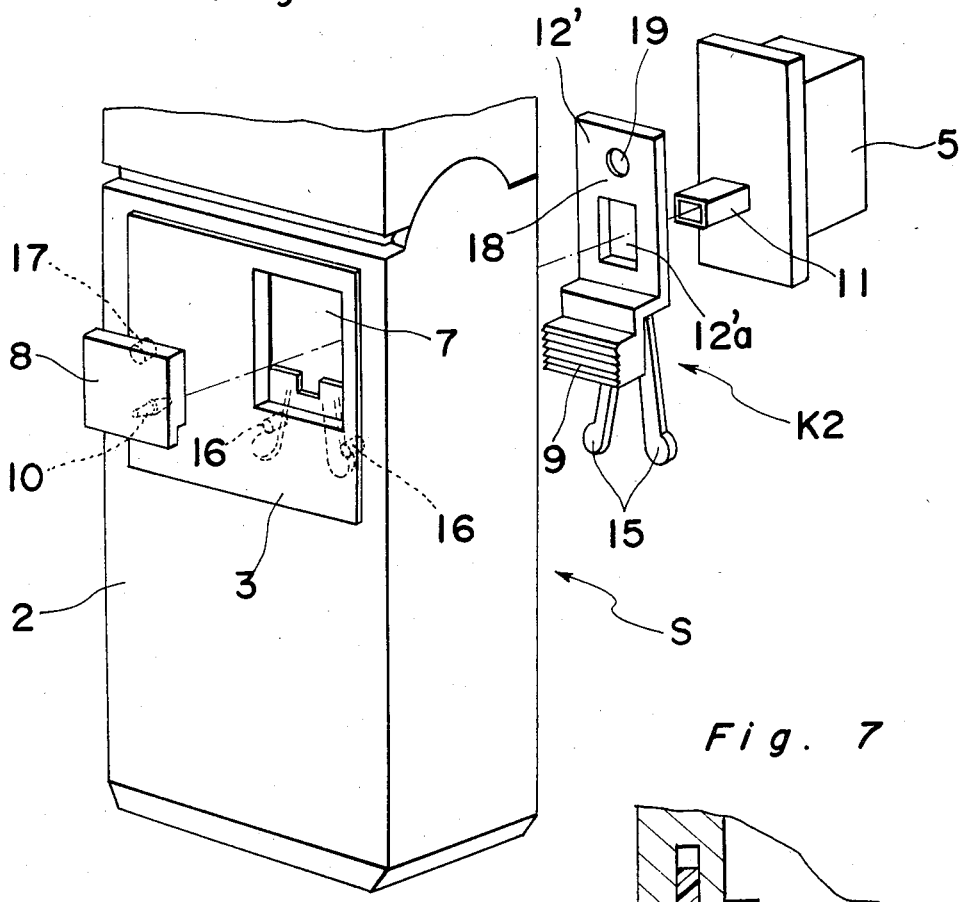
FIG. 6 is a view similar to FIG. 4, particularly showing the push-button switch locking device of FIG. 5.

More specifically, when the sliding knob 9 is displaced downwardly from the locking position of the push-button 8 to the unlocking position of the push-button 8 as shown in FIG. 5, the projection 17 is brought into alignment with the hole 19 such that the projection 17 is fitted into the hole 19 upon depression of the push-button 8, whereby the push-button 8 is unlocked. When the push-button 8 is depressed from the OFF position to the ON position at this time, the switch 5 is actuated so as to energize the power source of the electric shaver S. Subsequently, when the push-button 8 is depressed again, the push-button 8 is returned to the OFF position so as to project out of the opening 7.

Figure 7:
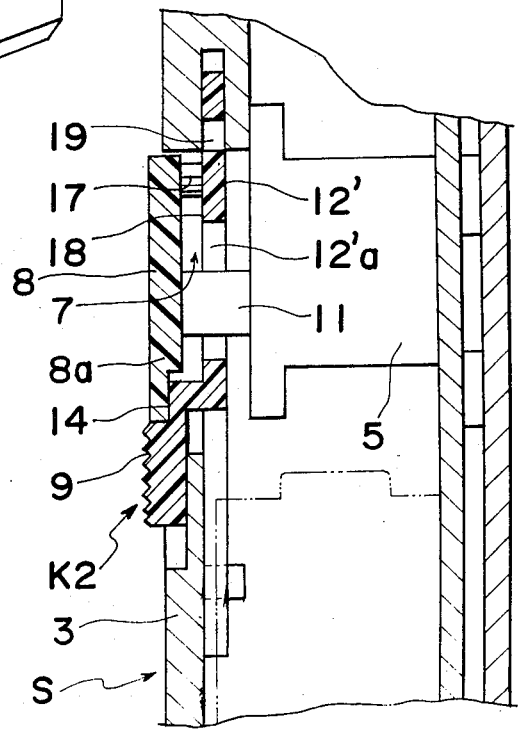
FIG. 7 is a view similar to FIG. 5, particularly showing a locking operation of the push-button switch locking device of FIG. 5.

On the contrary, when the sliding knob 9 is displaced upwardly from the unlocking position of the push-button 8 to the locking position of the push-button 8 as shown in FIG. 7, the projection 17 is brought into contact with the contact face 18 so as to prevent the push-button 8 from being depressed, whereby the push-button 8 is locked.

Although the projection 17 is provided on the inner face of the push-button 8 in the push-button switch locking device K2, it can be so arranged that the projection 17 is provided on the locking piece 12' and the contact face 18 and the hole 13 are formed on the inner face of the push-button 8.

Figure 8:
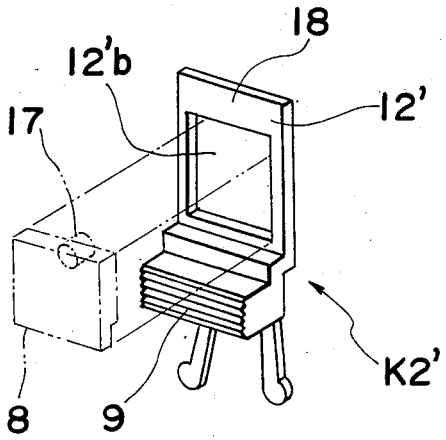
FIG. 8 is a view similar to a portion of FIG. 6, particularly showing a modification thereof.

Referring now to FIG. 8, there is shown a push-button switch locking device K2' which is a modification of the push-button locking device K2. The push-button switch locking device K2' includes an opening 12'*b* of rectangular shape formed on the locking piece 12'. Since the opening 12'*b* is formed larger than the push-button 8, the push-button 8 can be incorporated into the sliding knob 9 with much ease. By the above described arrangement of the push-button switch locking device K2', when the sliding knob 9 is disposed at the unlocking position of the push-button 8, the projection 17 is fitted into the opening 12'*b* such that the opening 12'*b* acts as both the opening 12'*a* and the hole 19 of the push-button switch locking device K2. It is to be noted here that the contact face 18 of the push-button switch locking device K2' is disposed above the opening 12'*b*.

Since other constructions of the push-button switch locking devices K2 and K2' are similar to those of the push-button switch locking device K1, description thereof is abbreviated for brevity.

Furthermore, the push-button 8 may be partially or as a whole made of a transparent material such that engagement between the projection 17 and the hole 19 can be visually inspected.

Moreover, it can be so modified that either one of the push-button 8 and the sliding knob 9 is made of a material more elastic than that of the other one of the push-button 8 and the sliding knob 9. By this arrangement, even if the sliding knob 9 is erroneously slid forcibly when the projection 17 is fitted into the hole 19, the either one of the push-button 8 and the sliding knob 9 is subjected to elastic deformation such that the projection 17 and the hole 19 in engagement with each other are not damaged.

Hereinbelow, a push-button switch locking device K3 according to a third embodiment of the present invention will be described with reference to FIGS. 9 to 12.

The push-button switch locking device K3 includes a push-button 22 and a sliding knob 23 provided in the push-button 22. It is so arranged that the sliding knob 23 is slid in the push-button 22 between the locking position of the push-button 22 and the unlocking position of the push-button 22 as described later. The push-button 22 of rectangular configuration has a recess 22*a* formed at a central portion of a front face thereof, a pair of slots 22*b* formed at opposite sides of the recess 22*a*, two pairs of hollows 22*c* formed on inner faces of the slots 22*b*, and the projection 10 extending from a rear face thereof. The sliding knob 23 has a plate-like operating portion 23*a*, a pair of legs 23*b* extending from a rear face of the operating portion 23*a*, an operating face 23*c* formed on a front face of the operating portion 23*a* and provided with a plurality of notches, a pair of projections 23*d* formed on inner faces of the legs 23*b*, and a pair of protrusions 23*e* formed on the inner faces of the legs 23*b* and disposed rearward of the projections 23*d*. Furthermore, the switch 5 has a pair of grooves 5*a* formed at opposite sides thereof, and a front face 5*b*. It should be noted that the legs 23*b* act as locking members.

Figure 11:
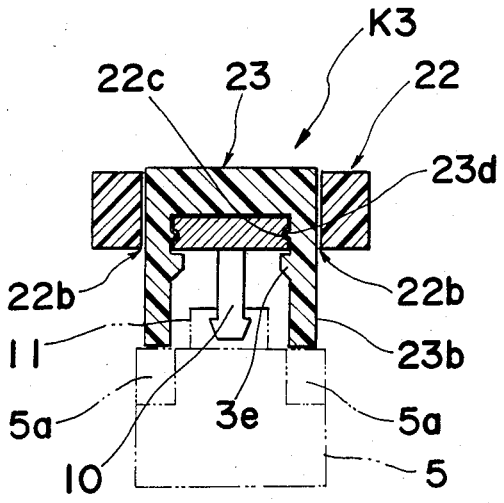
FIG. 11 is a transverse cross-sectional view of the push-button switch locking device of FIG. 9.
Figure 12:
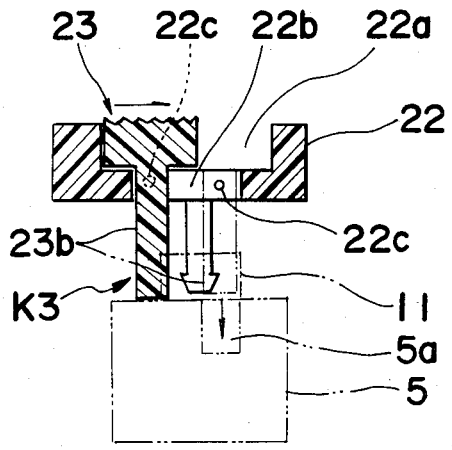
FIG. 12 is a longitudinal cross-sectional view of the push-button switch locking device of FIG. 9.

The operating portion 23*a* is slidably fitted into the recess 23*a* such that the legs 23*b* are inserted through the slots 22*b* as shown in FIG. 11. The sliding knob 23 can be slid in the recess 22*a* between the locking position of the push-button 22 and the unlocking position of the push-button 22 in the direction at right angles to the direction of the depression of the push-button 22, i.e. in upward and downward directions of the push-button switch locking device K3 by pushing the operating face 23*c*. The projections 23*d* are arranged to be fitted into the two pairs of the hollows 22*c* such that the locking and unlocking positions of the push-button 22 are determined, respectively. Meanwhile, it is so arranged that, when the sliding knob 23 has been mounted on the push-button 22, the protrusions 23*e* are brought into contact with a rear face of the push-button 22 so as to prevent the sliding knob 23 from being dropped from the push-button 22 and to guide the sliding motion of the sliding knob 23.

Furthermore, it is so arranged that, when the sliding knob 23 is disposed at the locking position of the push-button 22 (FIG. 9), the legs 23*b* are caused to confront the front face 5*b* so as to prevent the push-button 22 from being depressed and that, when the sliding knob 23 has been displaced upwardly from the locking position of the push-button 22 to the unlocking position of the push-button 22, the legs 23*b* are disposed above the grooves 5*a* of the switch 5 so as to allow the legs 23*b* to be fitted into the grooves 5*a*, respectively such that the push-button 22 can be depressed. Namely, the front face 5*b* is arranged to function as a locking member.

Figure 9:
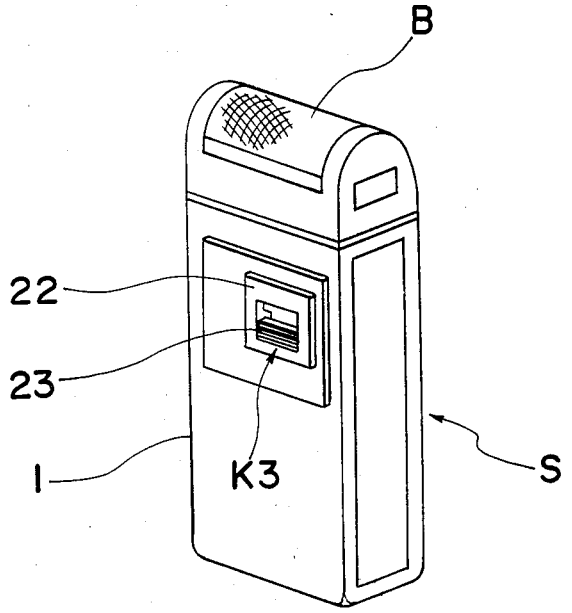
FIG. 9 is a view similar to FIG. 1, particularly showing an electric shaver provided with a push-button switch locking device according to a third embodiment of the present invention.
Figure 10:
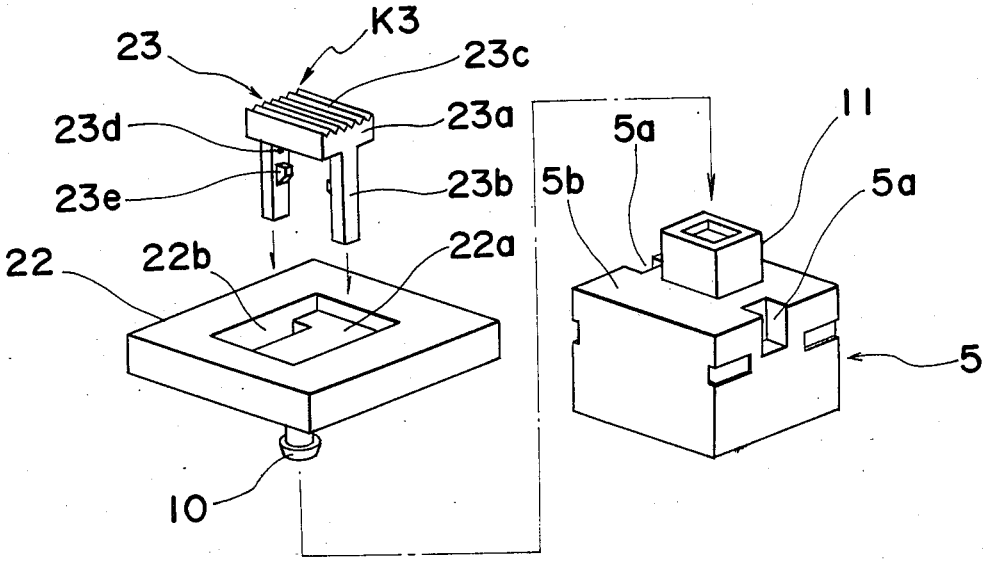
FIG. 10 is an exploded perspective view of the push-button switch locking device of FIG. 9.

By the above described arrangement of the push-button switch locking device K3, when the sliding knob 23 is disposed at the locking position of the push-button 22 as shown in FIG. 9, the legs 23*b* are brought into contact with the front face 5*b* lightly, so that the push-button 22 is securely locked. Subsequently, when the sliding knob 23 is slid upwardly from the locking position of the push-button 22 to the unlocking position of the push-button 22, the legs 23*b* are displaced to the position shown in imaginary lines in FIG. 12 so as to confront the grooves 5*a*, respectively as described above. Thereafter, when the push-button 22 is depressed toward the switch 5, the legs 23*b* are fitted into the grooves 5*a* such that the projection 10 is fitted into the sleeve 11, whereby the switch 5 is actuated.

Figure 13:
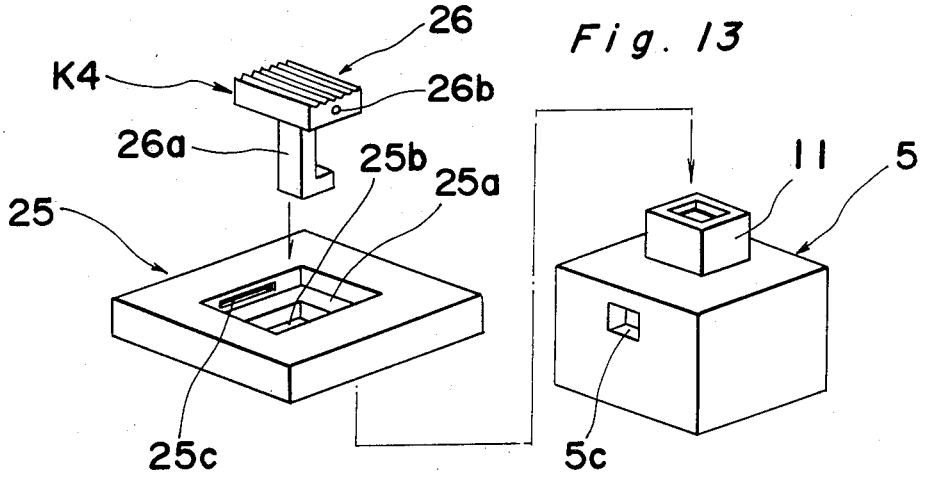
FIG. 13 is a view similar to FIG. 10, particularly showing a push-button switch locking device according to a fourth embodiment of the present invention.
Figure 14:
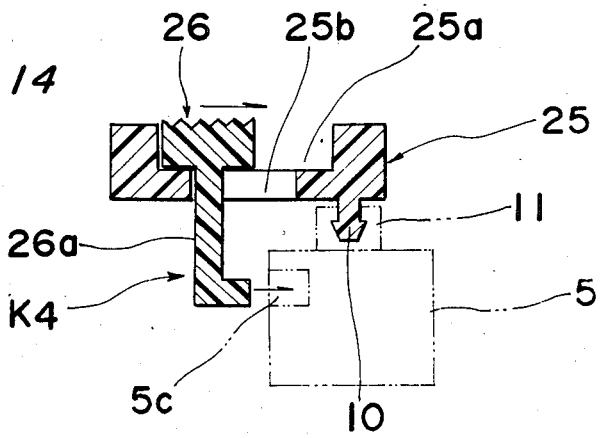
FIG. 14 is a transverse cross-sectional view of the push-button switch locking device of FIG. 13, FIGS. 15(*a*) and 15(*b*) are exploded perspective views of a push-button switch locking device according to a fifth embodiment of the present invention.
Figure 15:
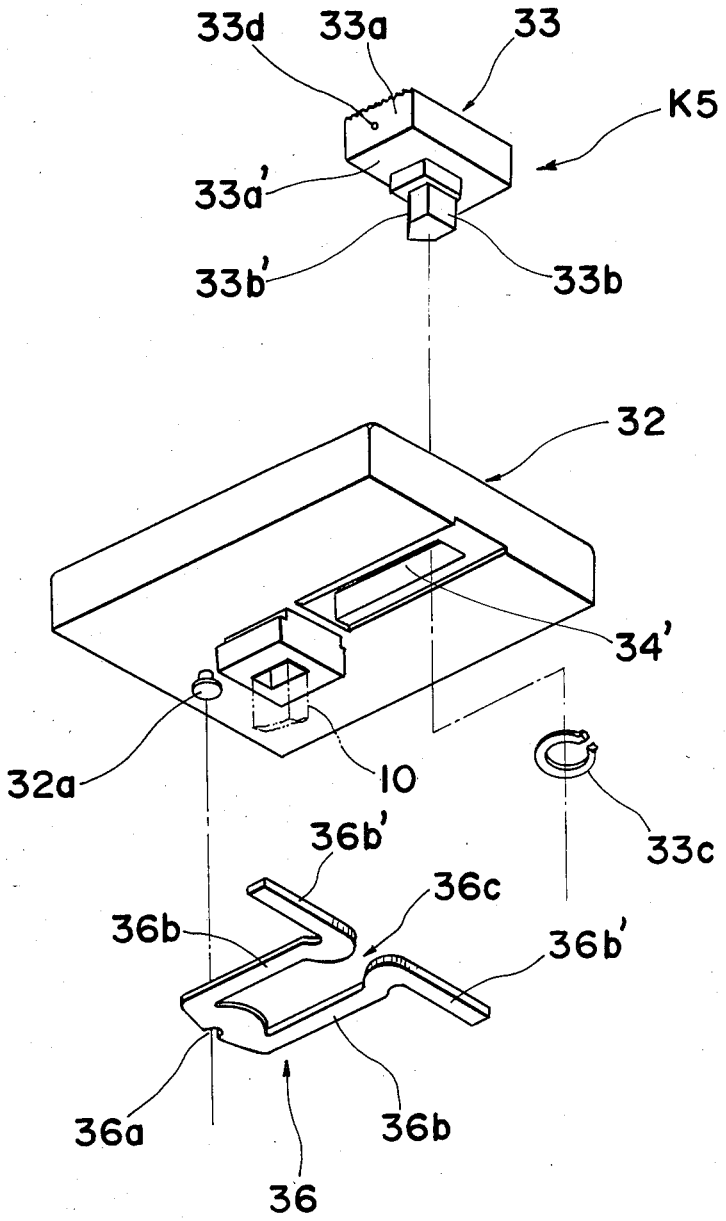
Figure 15B:
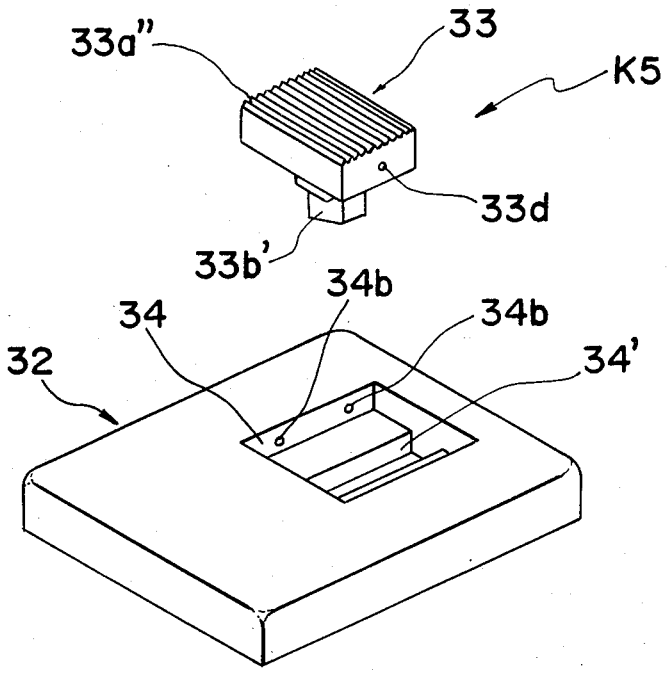

Hereinbelow, a push-button switch locking device K4 according to a fourth embodiment of the present invention will be described with reference to FIGS. 13 and 14.

The push-button switch locking device K4 includes a push-button 25 and a sliding knob 26 provided in the push-button 25. The push button 25 has a recess 25*a* formed at a central portion thereof, an elongated opening 25*b* formed at a bottom of the recess 25*a*, and a pair of slits 25*c* formed at opposite side faces of the recess 25*a*. The sliding knob 26 includes an L-shaped leg 26*a* extending from a rear face thereof and a pair of projections 26*b* formed at opposite sides thereof. It is so arranged that, when the sliding knob 26 is fitted into the recess 25*a* of the push-button 25, the leg 26*a* is inserted through the elongated opening 25*b* and the projections 26*b* are, respectively, fitted into the slits 25*c*, whereby the sliding knob 26 is slidably mounted in the recess 25*a*. Meanwhile, the switch 5 has a rectangular hole 5*c*.

By the above described arrangement of the push-button switch locking device K4, when the sliding knob 26 has been displaced to the locking position of the push-button 25, a distal end of the leg 25*a* is fitted into the hole 5*c*, whereby the push-button 25 is locked.

Hereinbelow, a push-button switch locking device K5 according to a fifth embodiment of the present invention will be described with reference to FIGS. 15 to 18.

Figure 17:
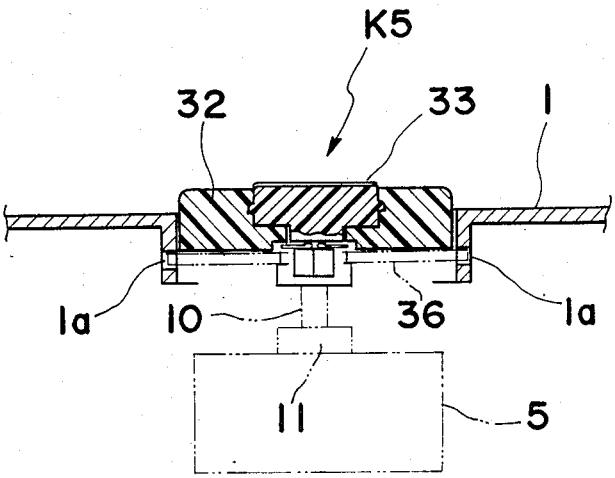
FIG. 17 is a transverse cross-sectional view of the push-button switch locking device of FIG. 15.

The push-button switch locking device K5 includes a push-button 32, a sliding knob 33 provided in the push-button 32, and a locking piece 36. The push-button 32 of rectangular shape has a recess 34 formed at a front face thereof, an elongated opening 34' formed at a bottom of the recess 34, and two pairs of hollows 34*b* formed at opposite side faces of the recess 34. The sliding knob 36 has a plate-like operating portion 33*a* and a protrusion 33*b* formed on a rear face 33*a'* of the operating portion 33*a*. The operating portion 33*a* has an operating face 33*a''* formed on a front face thereof and provided with a plurality of notches, and a pair of projections 33*d* formed at opposite sides thereof. The protrusion 33*b* has a triangular portion 33*b'* formed at an upper end thereof. The locking piece 36 is made of elastic synthetic resin and has a substantially U-shape. The locking piece 36 has a slit 36*a* formed at an upper end thereof, a pair of leg portions 36*b*, a pair of locking portions 36*b'* formed at lower ends of the leg portions 36*b* and extending outwardly at right angles to a direction of the leg portions 36*b*, and a cavity 36*c* defined between the locking portions 36*b'*. It is so arranged that when the protrusion 33*b* is inserted through the elongated opening 34' such that the rear face 33*a'* of the operating portion 33*a* is brought into contact with the bottom of the recess 34, the sliding knob 33 is slidably mounted in the recess 34 so as to be slid in a direction at right angles to the direction of the depression of the push-button 32, i.e. in upward and downward directions of the push-button switch locking device K5. A snap ring 33*c* is attached to the protrusion 33*b* so as to prevent the sliding knob 33 from being released from the push-button 32. The locking piece 36 is mounted on a rear face of the push-button 32 by fitting a pin 32*a* into the slit 36*a*. Furthermore, the projections 33*d* are arranged to be fitted into two pairs of the hollows 34*b* such that the locking and unlocking positions of the push-button 32 are determined, respectively. It is so arranged that, when the triangular portion 33*b'* of the sliding knob 33 is caused to proceed into the cavity 36*c* of the locking piece 36, the leg portions 36*b* are urged outwardly in opposite horizontal directions due to wedge effect such that the locking portions 36*b'* are fitted into a pair of slots 1*a* formed on the casing 1, respectively as shown in FIGS. 17 and 18.

Figure 16:
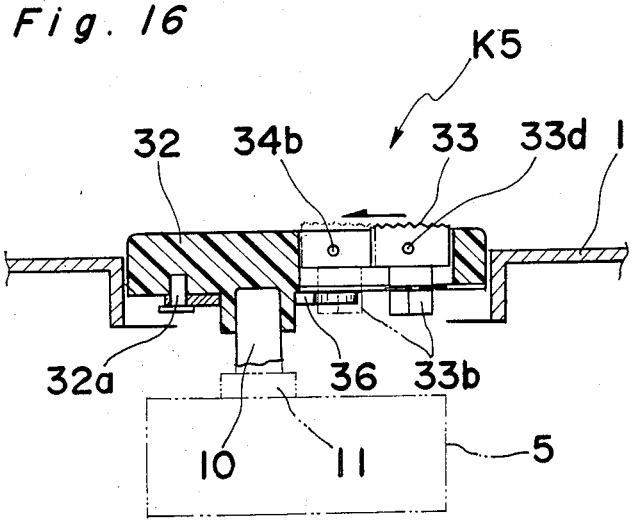
FIG. 16 is a longitudinal cross-sectional view of the push-button switch locking device of FIG. 15.
Figure 18:
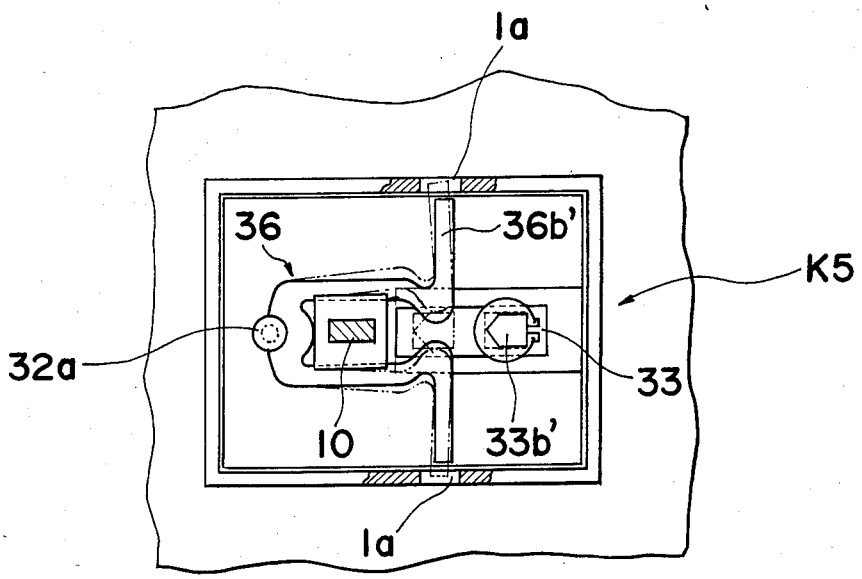
FIG. 18 is a bottom plan view of the push-button switch locking device of FIG. 15.

By the above described arrangement of the push-button switch locking device K5, when the sliding knob 33 is disposed at the unlocking position of the push-button 32 as shown in solid lines in FIG. 16, the leg portions 36*b* are closed such that the locking portions 36*b'* are retracted from the slots 1*a* as shown in solid lines in FIG. 18. Accordingly, when the push-button 32 is depressed at this time, the switch 5 is actuated by the projection 10.

Subsequently, when the sliding knob 33 is slid upwardly in the recess 34, the triangular portion 33*b'* of the sliding knob 33 is caused to proceed into the cavity 36*c* such that the leg portions 36*b* are urged outwardly in opposite horizontal directions due to wedge effect, so that the locking portions 36*b'* are projected outwardly so as to be fitted into the slots 1*a*, respectively as shown in imaginary lines in FIGS. 17 and 18, whereby the push-button 32 is locked.

Thereafter, in order to unlock the push-button 32, the sliding knob 33 is pushed downwardly, so that the triangular portion 33*b'* is released from the cavity 36*c* and thus, the leg portions 36*b* are caused to shrink by their own elasticity, whereby the lock portions 36*b'* are released from the slots 1*a*, respectively. Thus, it becomes possible to depress the push-button 32.

Figure 19:
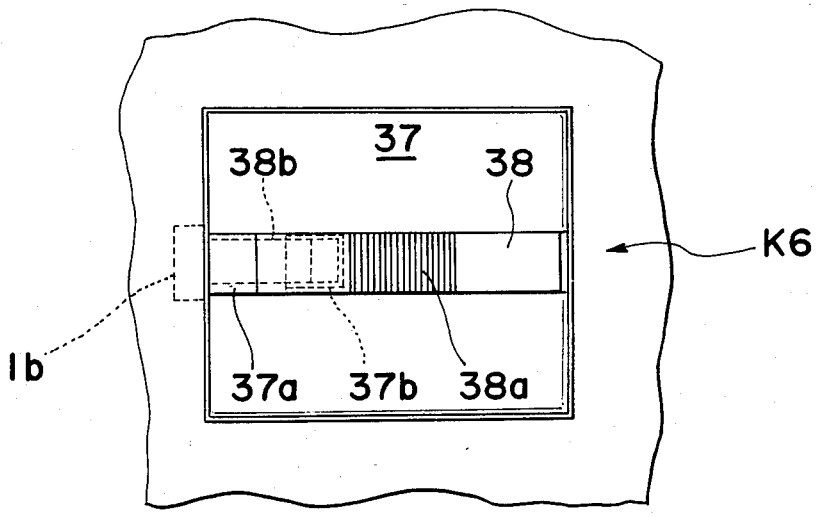
FIG. 19 is a top plan view of a push-button switch locking device according to a sixth embodiment of the present invention.

Hereinbelow, a push-button switch locking device K6 according to a sixth embodiment of the present invention will be described with reference to FIGS. 19 and 20.

The push-button switch locking device K6 includes a push-button 37 and a sliding knob 38 provided in the push-button 37. The push-button 37 has a groove 37*a* extending through opposite ends, and a through-hole 37 formed on the groove 37*a*. The sliding knob 38 has an operating face 38*a* formed at a front face thereof and provided with a plurality of notches, and a locking piece 38*b* extending upwardly thereof. The sliding knob 38 is slidably fitted into the groove 37*a* such that the locking piece 38*b* extends rearward of the push-button 37 through the through-hole 37*b*.

Furthermore, a bore 1*b* is formed on the casing 1 so as to confront the locking piece 38*b*.

Figure 20:
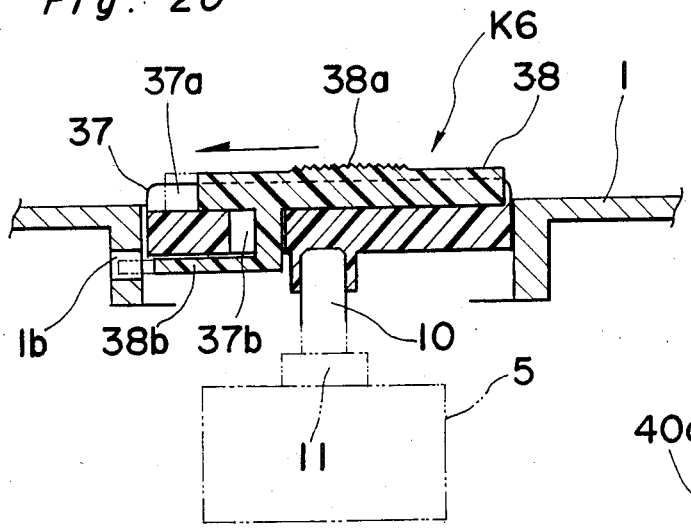
FIG. 20 is a longitudinal cross-sectional view of the push-button switch locking device of FIG. 19.

By the above described arrangement of the push-button switch locking device K6, when the sliding knob 38 is pushed upwardly, the locking piece 38*b* is fitted into the bore 1*b* of the casing 1 as shown in imaginary lines in FIG. 20, whereby the push-button 37 is locked.

On the contrary, when the sliding knob 38 is pushed downwardly, the push-button 37 is unlocked.

Figure 21:
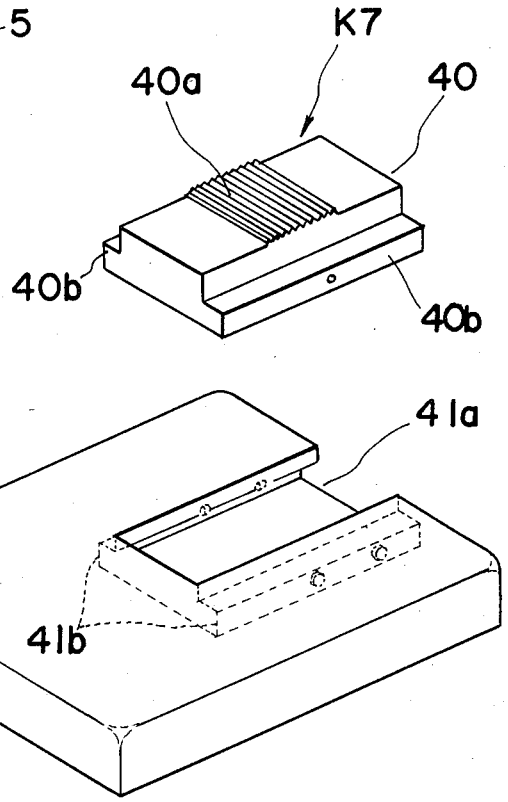
FIG. 21 is an exploded perspective view of a push-button switch locking device according to a seventh embodiment of the present invention.

Hereinbelow, a push-button switch locking device K7 according to a seventh embodiment of the present invention will be described with reference to FIGS. 21 and 22.

The push-button switch locking device K7 includes a push-button 41 and a sliding knob 40 provided in the push-button 41. The sliding knob 40 has an operating face 40*a* formed at a front face thereof and provided with a plurality of notches, and a pair of projections 40*b* formed at opposite sides thereof. The push-button 41 has a recess 41*a* formed at a lower central portion thereof, and a pair of guide grooves 41*b* formed at opposite sides of the recess 41*a*. The sliding knob 40 is slidably mounted in the recess 41*a* such that the projections 40*b* are fitted into the guide grooves 41*b*, respectively. Furthermore, a support face 1*c* is formed on the casing 1 so as to support the sliding knob 40.

Figure 22:
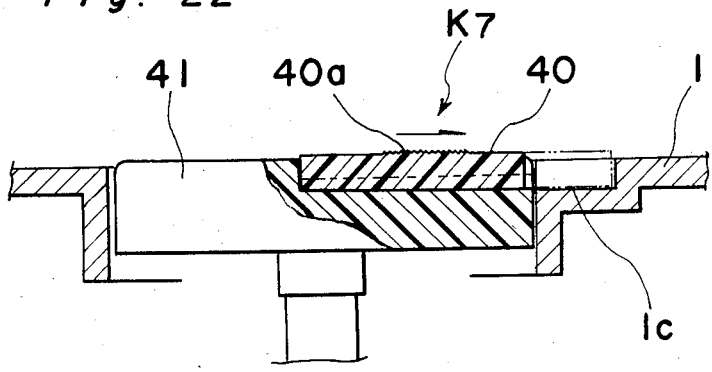
FIG. 22 is a longitudinal cross-sectional view of the push-button switch locking device of FIG. 21.

By the above described arrangement of the push-button switch locking device K7, when the sliding knob 40 is retracted into the recess 41*a* as shown in solid lines in FIG. 22, the push-button 41 is unlocked. On the contrary, when the sliding knob 40 is pushed downwardly, the sliding knob 41 is supported by the support face 1*c* as shown in imaginary lines in FIG. 22, whereby the push-button 41 is locked.

As is clear from the foregoing description, in accordance with the present invention, since the sliding knob of the push-button switch locking device is provided adjacent to the push-button switch so as to be slid in the direction at right angles to the direction of the depression of the push-button, the push-button switch and the sliding knob can be positively operated quickly with much ease.

Furthermore, in accordance with the present invention, the push-button switch locking device has been simplified in structure with a consequent minimized occurrence of its failure.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A push-button switch locking device for use in an electric appliance, comprising: a casing; a push-button mounted on a portion of the outer surface of said casing; a switch provided in said casing, said switch being connected to said push-button so as to be actuated upon depression of said push-button such that said push-button and said switch constitute a push-button switch; a sliding knob which is slidably mounted on the outer surface of said casing so as to be slid between a locking position of said push-button and an unlocking position of said push-button in a direction at right angles to the direction of depression of said push-button, said sliding knob being connected with a locking piece having a hole therein; and a projection mounted on said push-button for cooperating with said hole in said locking piece for preventing depression of said push-button when said sliding knob is in said locking position and for allowing depression of said push-button when said sliding knob is in said unlocking position, said sliding knob being integrally formed with said locking piece through a stepped portion such that upon actuation of the sliding knob perpendicular to the depression of said push-button, the locking piece cooperates with said projection thereby preventing the actuation of the switch by preventing depression of the push-button and at the same time the stepped portion engages the lower end portion of the push-button to support said push-button and positively prevent the depression of the push-button at its locked position.

2. A push-button switch locking device, comprising: a casing; a push-button mounted on a portion of the outer surface of said casing capable of being depressed in a first direction; a switch provided in said casing, said switch being connected to said push-button so as to be actuated upon depression of said push-button such that said push-button and said switch constitute a push-button switch; a sliding member which is slidably mounted on the outer surface of said casing capable of being slid between a locking position and an unlocking position in a direction at right angles to the direction of depression of said push-button, said sliding member having a sliding knob connected with a locking piece located under said push-button which prevents depression of said push-button at a plurality of spaced positions, wherein a projection is provided on said push-button or said locking piece and a contact face and a hole are provided on the other of said push-button or locking piece, said projection, contact face and hole being arranged relative to each other such that said projection contacts said contact face at said locking position to prevent depression of said push-button when said sliding member is in said locking position and said projection is in alignment with said hole at said unlocking position to allow depression of said push-button when said sliding member is in said unlocking position.

3. The push-button switch locking device of claim 2, wherein said push-button or said sliding member is supported by said casing adjacent to said contact face.

4. The push-button switch locking device of claim 2, wherein said sliding member is supported by said casing adjacent to said contact face.

5. The push-button switch locking device of claim 2, wherein said push-button and said sliding member are made of materials having different elasticity.

* * * * *